US008684615B2

(12) United States Patent
Lecoutre

(10) Patent No.: US 8,684,615 B2
(45) Date of Patent: Apr. 1, 2014

(54) APPLICATOR DEVICE FOR FLUID PRODUCT

(75) Inventor: Jean-Paul Lecoutre, Conde sur Iton (FR)

(73) Assignee: Aptar France SAS, Le Neubourg (FR)

( * ) Notice: Subject to any disclaimer, the term of this patent is extended or adjusted under 35 U.S.C. 154(b) by 455 days.

(21) Appl. No.: 13/054,394

(22) PCT Filed: Jul. 10, 2009

(86) PCT No.: PCT/FR2009/051383

§ 371 (c)(1),
(2), (4) Date: Jan. 14, 2011

(87) PCT Pub. No.: WO2010/007301

PCT Pub. Date: Jan. 21, 2010

(65) Prior Publication Data

US 2011/0129287 A1 Jun. 2, 2011

(30) Foreign Application Priority Data

Jul. 16, 2008 (FR) ..... 08 54840

(51) Int. Cl.
*A46B 11/00* (2006.01)

(52) U.S. Cl.
USPC ..... 401/126; 401/122; 132/218

(58) Field of Classification Search
USPC ..... 401/121, 122, 126–130; 132/218
See application file for complete search history.

(56) References Cited

U.S. PATENT DOCUMENTS

| | | | | |
|---|---|---|---|---|
| 4,407,311 | A * | 10/1983 | Gueret | 401/122 |
| 4,841,996 | A | 6/1989 | Gueret | |
| 5,180,241 | A | 1/1993 | Gueret | |
| 5,875,791 | A * | 3/1999 | Sheffler et al. | 132/218 |
| 6,010,265 | A * | 1/2000 | Bouix | 401/122 |
| 6,033,142 | A | 3/2000 | Gueret | |
| 6,375,374 | B2 * | 4/2002 | Gueret | 401/122 |
| 6,502,584 | B1 * | 1/2003 | Fordham | 401/122 |
| 7,476,044 | B2 * | 1/2009 | Gueret | 401/122 |
| 7,695,209 | B2 * | 4/2010 | Perignon | 401/133 |
| 8,142,093 | B2 * | 3/2012 | Vanoncini | 401/122 |
| 2005/0133541 | A1 * | 6/2005 | Garcia et al. | 222/401 |

FOREIGN PATENT DOCUMENTS

| | | |
|---|---|---|
| EP | 0 485 247 A1 | 5/1992 |
| EP | 0 829 211 A1 | 3/1998 |
| FR | 2 579 430 A2 | 10/1986 |
| FR | 2 599 230 A2 | 12/1987 |

* cited by examiner

*Primary Examiner* — David J. Walczak
*Assistant Examiner* — Jennifer C Chiang
(74) *Attorney, Agent, or Firm* — Sughrue Mion, PLLC

(57) ABSTRACT

A fluid applicator device, comprising: a fluid reservoir (1) including a neck (11) defining an inside wall (12) defining an opening (10); a fastener collar (2) that is assembled in sealed manner on the neck (11) of the reservoir, the collar (2) defining an orifice (24); and a closure member (3) that is capable of closing the orifice (24) of the collar (2), the closure member including a fluid extractor and/or applicator element (31) that extends through the orifice of the collar and into the reservoir (1); the collar having wiper means (25) formed integrally therewith for wiping the extractor and/or applicator element (31) while it is being removed from the reservoir; the device being characterized in that the wiper means (25) are movable between an initial position prior to being assembled on the neck, and a final position after being assembled on the neck, the wiper means (25) being constrained in the final position by the neck (11) of the reservoir.

11 Claims, 4 Drawing Sheets

APPLICATOR DEVICE FOR FLUID PRODUCT

The present invention relates to a fluid applicator device comprising: a fluid reservoir; a fastener collar that is assembled on the reservoir; and a closure member that is capable of closing an orifice that is formed by the collar, the closure member including an extractor and/or applicator element that extends through the orifice of the collar and into the reservoir. Advantageous fields of application of the present invention are the fields of cosmetics, perfumery, or even pharmacy. However, other technical fields may be concerned.

In the prior art, document WO 2005/105598 describes an applicator device that is more particularly for the specific field of perfume samples. The reservoir is in the form of a small bottle, e.g. made of glass, including a neck defining an inside wall defining an opening that puts the inside of the reservoir into communication with the outside. The applicator device of that document also includes a fastener collar, e.g. made of plastics material, that is assembled in sealed manner on the neck of the reservoir. The collar defines an orifice through which the closure member extends. The closure member comprises: a handle by means of which the user may hold the closure member; and a fluid extractor and/or applicator element that extends through the orifice of the collar and into the reservoir. The free end of the extractor element is dipped in the fluid stored in the reservoir. Thus, the extractor element makes it possible to extract fluid from the reservoir. The closure member may be removed from the fastener collar by pulling the extractor element out of the reservoir, through the orifice of the collar. Then, the user may apply the fluid on the extractor element to the desired application surface. When the fluid is a perfume, the applicator element may be merely in the form of a small stem of plastics material on which a small quantity of perfume may become attached. The extractor element may be in other shapes that make it possible to extract more fluid.

However, in certain kinds of application, it is necessary for the quantity of extracted fluid to be sufficient, but not excessive. In addition, it may also be important to distribute the fluid in uniform manner over a certain length of the extractor element. In other kinds of application, it suffices to avoid any risk of fluid droplets being lost once the extractor element has been removed from its reservoir. These various problems must be solved but without that increasing the cost of manufacturing the applicator device, nor of assembling it.

To do this, the present invention proposes a fluid applicator device comprising: a fluid reservoir including a neck defining an inside wall defining an opening; a fastener collar that is assembled in sealed manner on the neck of the reservoir, the collar defining an orifice; and a closure member that is capable of closing the orifice of the collar, the closure member including a fluid extractor and/or applicator element that extends through the orifice of the collar and into the reservoir; the collar having wiper means formed integrally therewith for wiping the extractor and/or applicator element while it is being removed from the reservoir; the device being characterized in that the wiper means are movable between an initial position prior to being assembled on the neck, and a final position after being assembled on the neck, the wiper means being constrained in the final position by the neck of the reservoir.

As a result of the wiper means forming an integral part of the collar, there is no additional part to assemble in the applicator device. The wiper means are put into place inside the reservoir merely by assembling the collar on the neck of the reservoir.

Advantageously, the wiper means are constrained in the final position by the inside wall of the neck. In a variant or in addition, it is possible to constrain the wiper means by the top edge of the neck.

In a practical embodiment, the wiper means may comprise a plurality of tabs that are movable radially inwards towards the extractor and/or applicator element by contact with the neck. Advantageously, the tabs define top junction ends and bottom free ends, the free ends being movable radially inwards by means of the tabs pivoting about the junction ends. Advantageously, each tab includes an outer cam profile in the proximity of its junction end, the cam profile coming into engagement with the inside wall of the neck so as to cause the free end of the tab to pivot inwards. Preferably, the free ends of the tabs are separated from one another by slots in their initial position, and are substantially touching in their final position, so as to co-operate with one another to define a wiper ring. The number of tabs, and consequently of slots, may vary from two to more than ten. The tabs may be rigid or undeformable in themselves, while still being movable by pivoting at their top ends where they join the remainder of the fastener collar. The rigidity of the tabs makes it possible, in the final assembled position, to create a rigid wiper ring that does not tend to deform while wiping the extractor element. However, tabs, or more generally the wiper means, could be made in such a manner as to be deformable, at least locally, e.g. by flexing.

According to another advantageous characteristic of the invention, the inside wall of the neck includes an inner inlet bevel for initiating the movement of the wiper means from their initial position to their final position. The inlet bevel not only avoids the wiper means, e.g. the tabs, abutting directly against the top edge of the neck, but also ensures that the wiper means are moved in appropriate manner, so as to achieve their final assembled position in which they form the wiper ring. The inlet bevel thus fulfils two functions.

In another advantageous aspect of the present invention, the collar includes a sealing skirt that is capable of coming into sealing contact with the inside wall of the neck, the wiper means being formed integrally to extend the skirt. It is also possible to consider that the wiper means, particularly when they are made in the form of tabs that are separated by slots, form an integral part of the skirt that may thus be divided into two sections, namely a continuous rigid top section and a discontinuous bottom section that is deformable radially inwards.

In a practical embodiment, said collar and said closure member are made integrally by being connected together via a bridge of material that breaks during first use. Advantageously, the orifice of the collar is defined by a peripheral edge that is connected via said bridge of material to a junction surface of the extractor and/or applicator element, said peripheral edge coming into sealing contact against a sealing surface of said extractor and/or applicator element after said bridge of material has been broken. It is thus possible to make the closure member integrally with the collar that forms the wiper means. In addition, after being removed for the first time from the collar, the closure member may be repositioned on the collar in sealed manner and advantageously snap-fastened thereon.

The invention is described more fully below with reference to the accompanying drawings which show an embodiment of the invention by way of non-limiting example.

Figure 2:
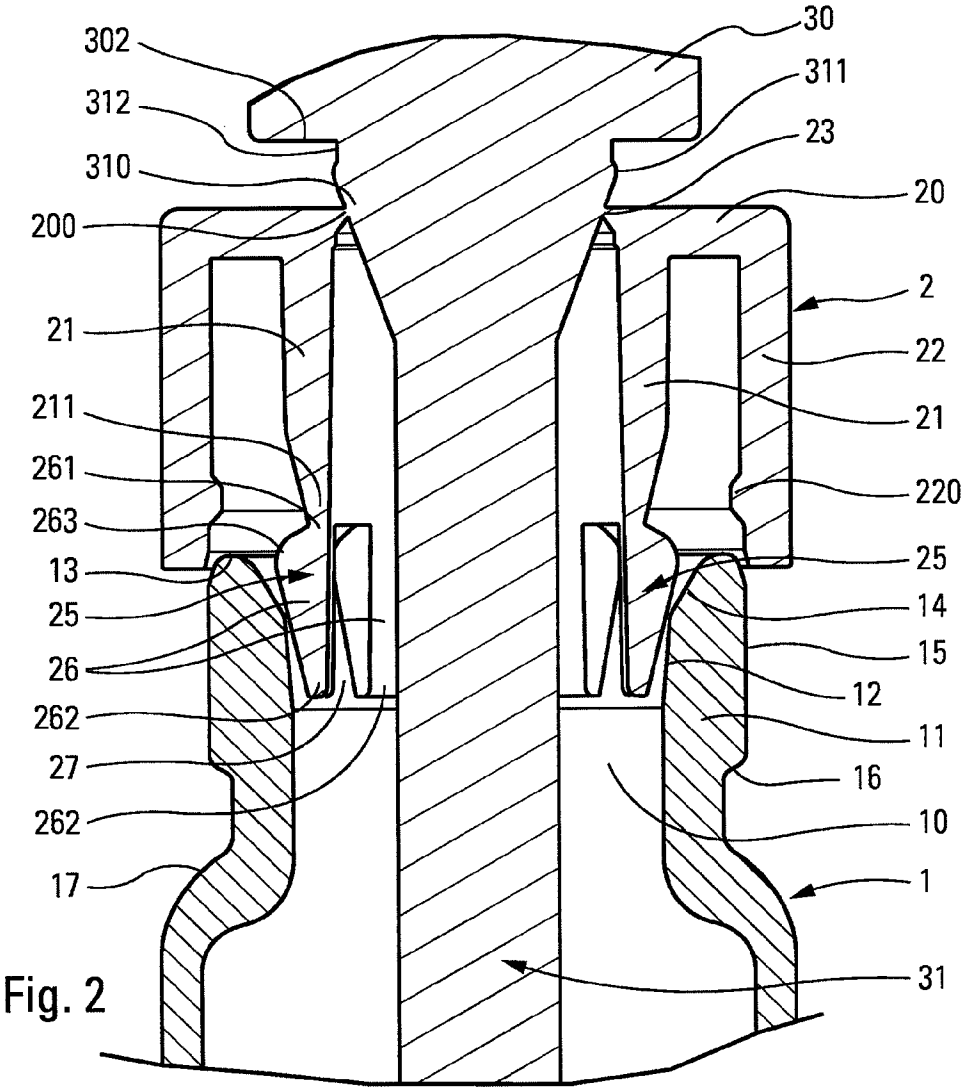
FIG. 2 is a larger-scale view of a detail A of FIG. 1.

With reference to the figures, the fluid dispenser of the invention comprises a reservoir 1 on which there is mounted a stopper that comprises a fastener collar 2 and a closure member 3.

The reservoir 1 is for containing fluid such as a lip gloss, a mascara, a pomade, a cream, a lotion, or a perfume. It may be made of glass or of plastics material. The reservoir 1 includes a neck 11 forming an opening 10 for putting the inside of the reservoir into communication with the outside. The neck 11 comprises: an inside wall 12 defining the opening 10 of the neck; a top end 13; and an outside wall 15. A fastener rim 16 is formed on the outside wall 15: the rim is used to fasten the collar 2. The neck 11 also forms an inlet bevel 14 that connects the top end 13 to the inside wall 12. The bevel 14 makes it easier to assemble the collar on the neck 11, but it also performs another function, as described below. Below the rim 16, the neck 11 forms a narrowing prior to widening once again, forming a shoulder 17. Then, the reservoir includes a cylinder 18 that is closed by a bottom wall 19. By way of example, the outside wall of the cylinder 18 may be circularly cylindrical. The capacity of the reservoir is generally of the order of a few milliliters.

As mentioned above, the stopper comprises two component elements, namely: the fastener collar 2; and the closure member 3.

The fastener collar 2 comprises a radial plate 20, a sealing skirt 21, and a fastener ring 22.

The radial plate 20 forms a top surface that is advantageously circular and plane.

The sealing skirt 21 extends axially downwards from the radial plate 20.

The ring 22 extends axially from the outer periphery of the radial plate 20, coaxially about the sealing skirt 21, and includes a bottom end that is provided with a snap-fastener profile 220 that projects inwards.

Thus, when the collar 2 is assembled on the neck 11 of the reservoir 1, the ring 22 is in contact with the outside wall 15, and the snap-fastener profile 220 is thus engaged below the rim 16. Advantageously, the ring 22 extends in alignment with the cylinder 18, thereby advantageously imparting a generally-tubular appearance. The radial plate 20 is advantageously disposed in such a manner as to come to bear against the top end 13 of the neck. The sealing skirt 21 itself comes to be housed in the opening of the neck, advantageously in sealing contact with the inside wall 12, so as to avoid any possibility of leakage between the neck and the collar.

In the invention, the fastener collar 2 further includes wiper means 25 that are made integrally with the remainder of the collar. In other words, the fastener collar 2 is a single piece of injection-molded plastics material that forms the plate 20, the skirt 21, the ring 22, and the wiper means 25. In the non-limiting embodiment of the invention, the wiper means 25 extend the skirt 21: more precisely, the skirt 21 includes a bottom end 211 to which the wiper means are integrally connected. It should also be considered that the wiper means 25 form an integral part of the skirt 21, which wiper means comprise a top portion for providing sealing with the inside wall 12 of the neck, and a bottom portion that forms the wiper means 25. In a variant, it is also possible to connect the wiper means 25 directly to the plate 20 without forming a sealing skirt 21. It is also possible to connect the wiper means 25 to the plate 20 via an intermediate section that does not necessarily fulfill the function of the sealing skirt 21. The function and the use of the wiper means 25 are described below.

In this non-limiting embodiment, the wiper means 25 include a plurality of tabs 26 that are connected to the bottom end 211 of the skirt 21. The tabs 26 are separated by slots 27 of longitudinal shape that initially extend axially. The slots 27 open downwards and extend up to the bottom end 211 of the skirt 21. Each tab 26 includes a top junction end 261 that is connected to the bottom end 211 of the skirt 21, and a bottom free end 262. In the proximity of the top junction end 261, each tab further includes a cam profile 263 that projects radially outwards. The cam profile 263 is situated on the outside face of the tab 26, while its inside face may be cylindrical without forming any particular profile.

Figure 1:
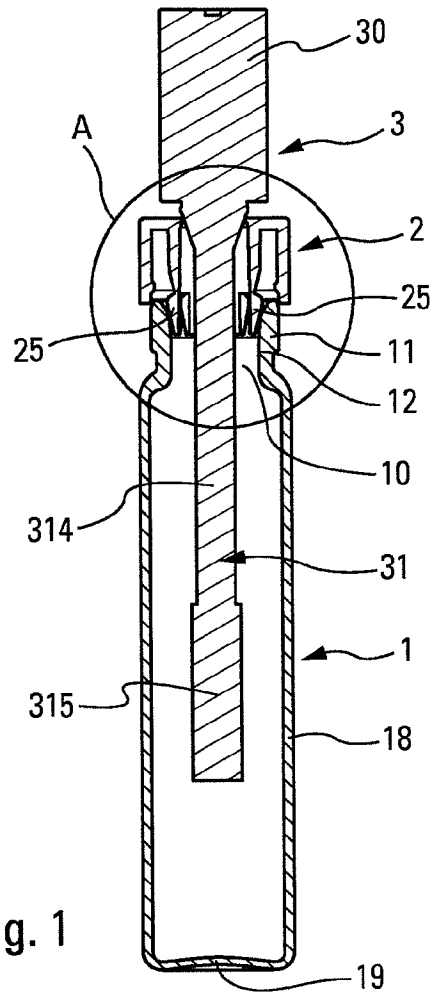
FIG. 1 is a vertical section view through an applicator device of the present invention at the start of the assembly stage.

According to an advantageous characteristic of the invention, the tabs 26, that together constitute the wiper means 25, are movable radially inwards by pivoting about their junction ends 261. The tabs 26 are thus displaceable or movable between an initial position prior to being assembled in the neck, shown in FIGS. 1 and 2, and a final position after being assembled in the neck, shown in FIGS. 5 to 8. It can easily be observed that the final position, after being assembled in the neck, is obtained by the tabs 26 pivoting inwards about their top ends 261. Although moved by pivoting inwards, the tabs 26 remain substantially rigid or undeformed except at the junction between their top ends 261 and the bottom end 211 of the skirt 21. However, wiper means could be provided that are deformable locally or in part. Nevertheless, in the preferred embodiment of the invention, the tabs 26 are substantially undeformable, and are thus moved between the initial position and the final position without being subjected to significant deformation. Movement between the two positions is determined by the cam profile 263 coming into contact with the inside wall 12 of the neck 11.

Figure 4:
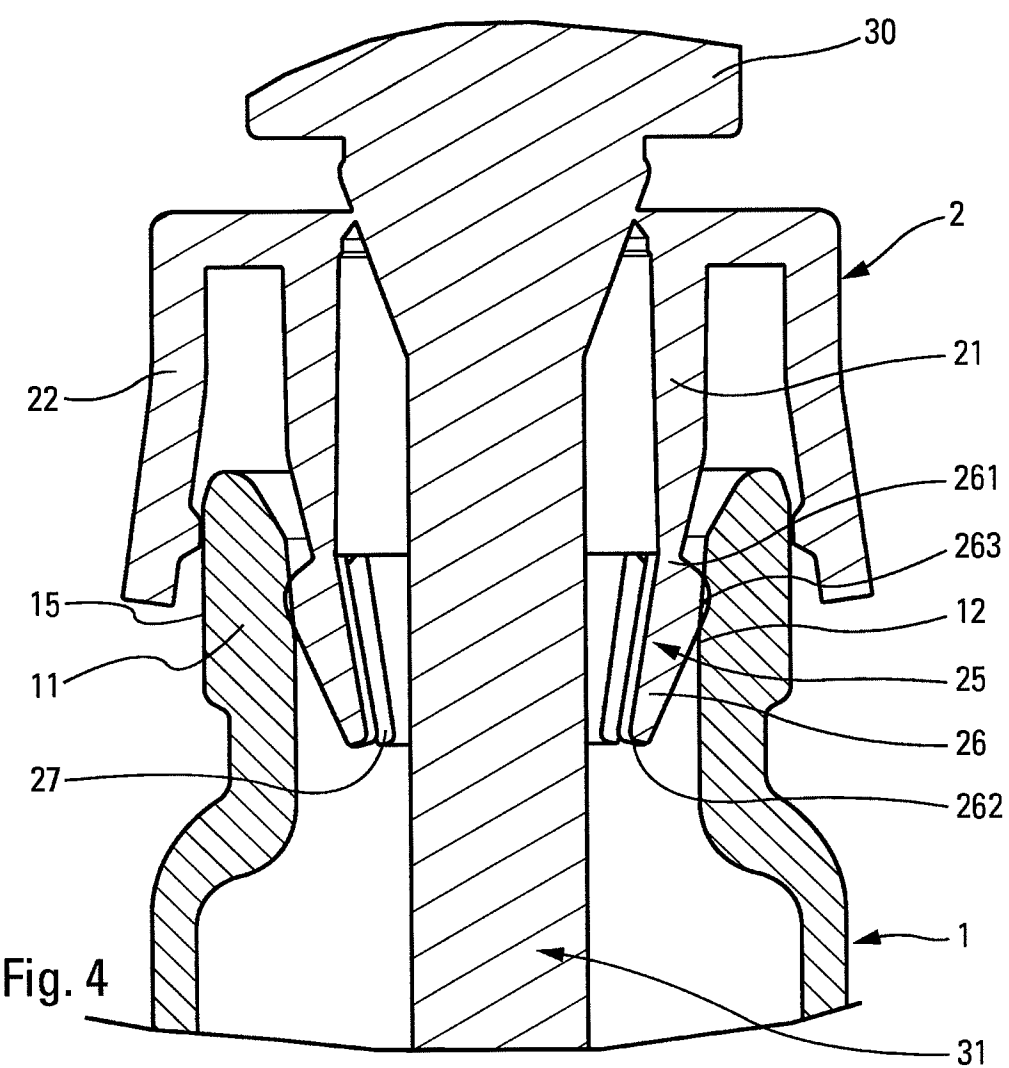
FIG. 4 is a larger-scale view of a detail B of FIG. 3.
Figure 3:
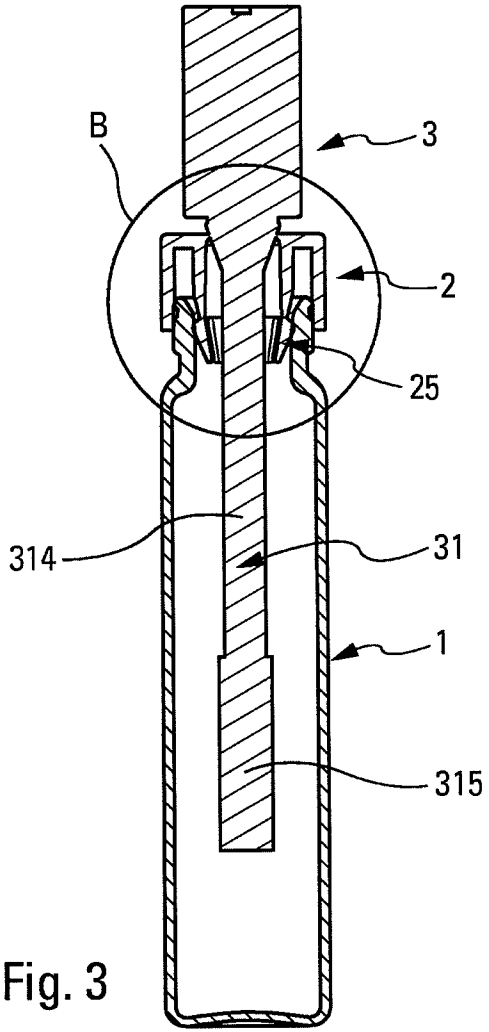
FIG. 3 is a view similar to the view in FIG. 1 during assembly.

In the initial position prior to assembly, the outside diameter of the wiper means 25 at the cam profiles 263 of the tabs 26 is greater than the inside diameter of the neck at the inside wall 12. Internally, the wiper means are of a shape that is substantially cylindrical. Engaging the wiper means 25 inside the neck 11 puts the cam profiles 263 into contact with the inside wall 12. Firstly, the bottom ends 262 of the tabs are engaged inside the neck 11: this engagement is made easier by the inlet bevel 14 that avoids any risk of abutting directly against the top end 13 of the neck. Given that the tabs flare outwards from the bottom ends 262 up to the cam profiles 263, they necessarily come into contact with the inside wall 12 and/or with the inlet bevel 14. In FIG. 2, it can clearly be observed that the cam profiles 263 are not yet engaged inside the inside wall 12. At this stage, they are situated just above or level with the top end 13. Contact between the wiper means 25 and the neck 11 has not yet taken place. In addition, the outer ring 22 has not yet come into contact with the neck 11. By continuing to engage the fastener collar 2 in and around the neck 11, the ring 22 is engaged around the outside wall 15 of the neck by deforming radially outwards, and the wiper means 25 are situated with their cam profile 263 against the inside wall 12. This is shown in FIG. 4. Given that the profiles 263 define a diameter that is greater than the diameter of the inside wall 12, the tabs 26 are constrained to pivot inwards. Given that the cam profiles 263 are situated in the proximity of the top junction ends 261, pivoting is accentuated by a lever effect, thereby causing the bottom free ends 262 to move radially inwards rapidly, and to move closer together.

Figure 6:
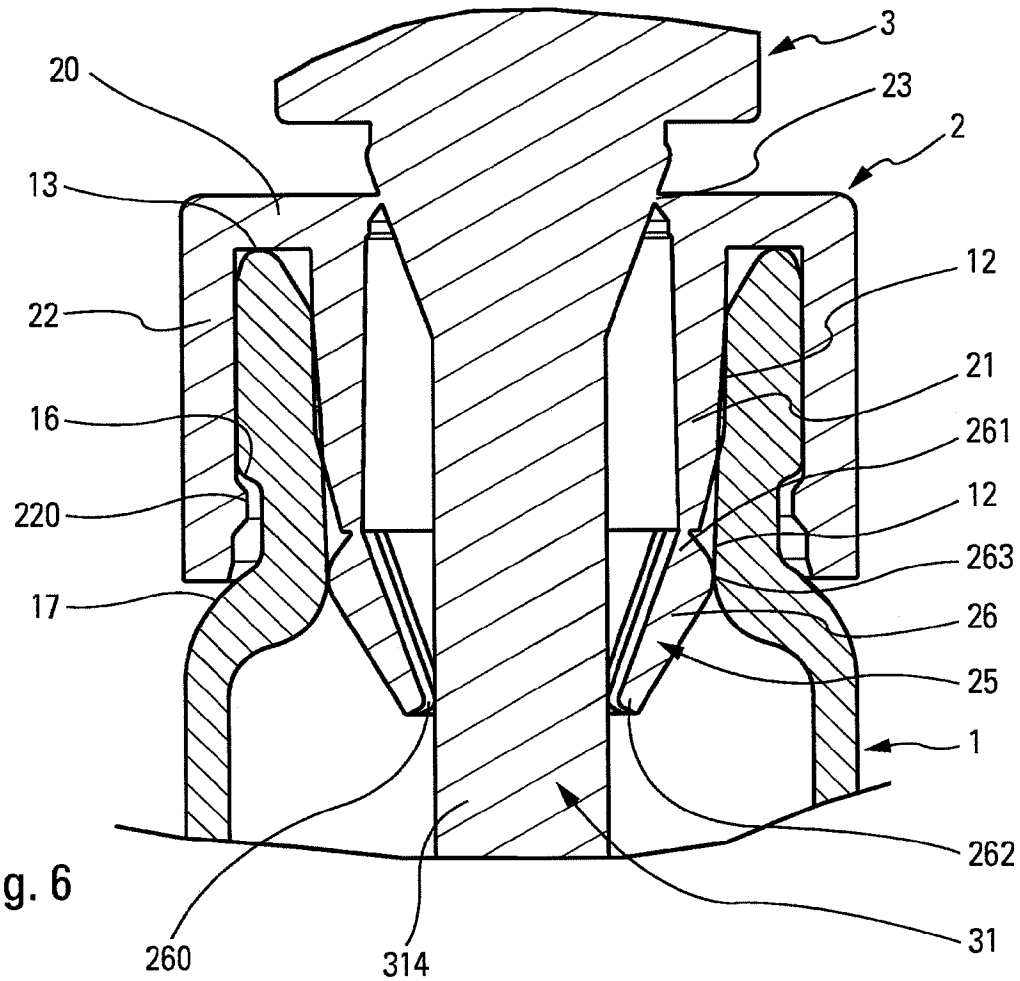
FIG. 6 is a larger-scale view of a detail C of FIG. 5.
Figure 5:
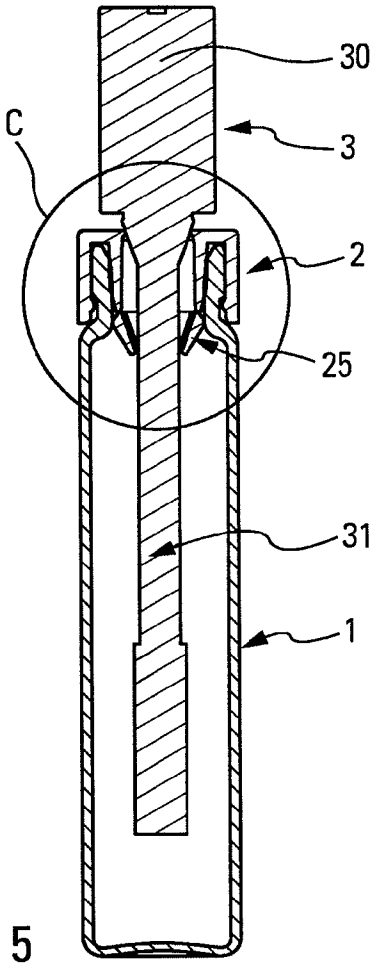
FIG. 5 is a view similar to the views in FIGS. 1 and 3 in the final assembled position.
Figure 8:
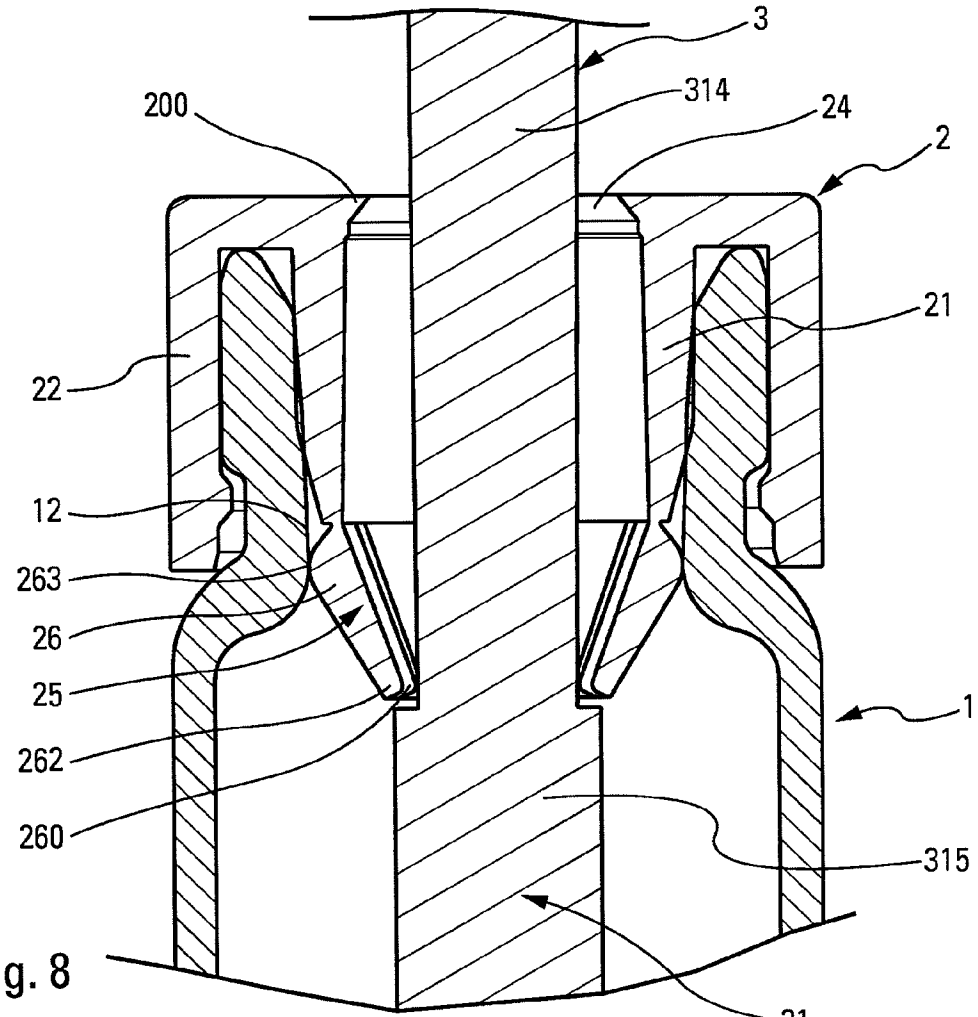
FIG. 8 is a larger-scale view of a detail D of FIG. 7.
Figure 7:
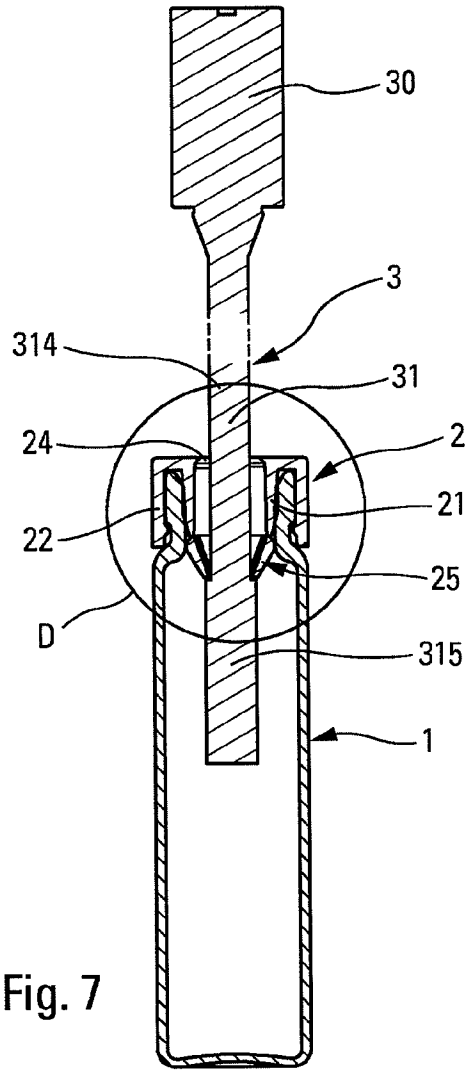
FIG. 7 is a view similar to the views in FIGS. 1, 3, and 5 during use of the applicator device.

By continuing to engage the collar 2 on the neck 11, the final assembled position is reached, as shown in FIGS. 5 to 8. The snap-fastener profile 220 of the ring 22 is thus engaged below the rim 16 of the neck, and the skirt 21 is in sealing contact with the inside wall 12 of the neck. In addition, the plate 20 is in abutment against the top end 13 of the neck. A stable and sealed fastening of the collar 2 on the neck 11 is thus guaranteed. The wiper means 25 are in their final, operating position. The tabs 26 are maximally pivoted radially inwards under the cam effect generated between the profiles 263 and the inside wall 12. The cam profiles 263 are situated substantially in the proximity of the bottom end of the neck level with the shoulder 17. Together, the bottom free ends 262 of the tabs define a wiper ring 260. The bottom ends 262 are advantageously in contact with one another so as to form a continuous ring. In a variant, it is possible that gaps remain between the free ends 262, so that the wiper ring 260 is discontinuous. It can also be said that the slots 27 that separate the tabs 26 are clamped together or closed at their bottom ends 262, while at their top ends 261, the width of the slots remains unchanged. Thus, between the initial position and the final position, the slots pass from a shape that is substantially rectangular to a shape that is substantially triangular. Reference is made below to FIGS. 7 and 8 in order to describe the operation of the wiper means.

The closure member 3, preferably made of injection-molded plastics material, comprises a handle 30 and a fluid extractor and/or applicator element 31.

The handle 30 is for being held by a user while fluid is being applied, and it may present any appropriate shape. In a preferred embodiment, the handle 30 includes two opposite faces presenting a shape that is curved, and more particularly concave. This embodiment is particularly advantageous, making it easier to hold the closure member 3 in the hand, and to remove it from the reservoir 1.

The extractor and/or applicator element 31 has the function of making it possible to extract a given quantity of fluid. The element 31 presents a configuration that is generally elongate. It comprises a stem 314 that is connected at its top end to the handle 30, and that defines at its bottom end an extractor and/or applicator section 315 that may be made of an absorbent material. The section 315 may be in the form of a brush or of a cylindrical pad having an outside diameter that is advantageously greater than the outside diameter of the stem 314.

The extractor element 31 also has the function of making it easier to put the closure member back into place on the collar. The element 31 advantageously includes a junction surface 310, a snap-fastener bead 311, and a sealing surface 312. The junction surface 310 is a circularly-cylindrical surface that extends over the periphery of the element 31. The snap-fastener bead 311 forms an annular flange that projects radially from the element 31. The sealing surface 312 itself also corresponds to a circularly-cylindrical surface that extends over the periphery of the element 31. Advantageously, the junction surface 310 and the sealing surface 312 are situated on either side of the snap-fastener bead 311. In the embodiment shown in the various figures, the junction surface 310 is situated below the snap-fastener bead 311, while the sealing surface 312 is located between the snap-fastener bead 312 and the base 302 of the handle 30. The sealing surface 312 thus defines a sealing snap-fastener housing between the bead 311 and the base 302.

The extractor element 31 advantageously extends from the base 302, through the collar 2, and into the reservoir 1. However, it should be observed that the depth to which the section 315 of the element 31 extends may vary greatly. The element 31 may have a very short stem 314 that does not go beyond the end of the collar 2, or, in contrast, it may have a very long stem that comes almost into contact with the bottom wall 19 of the reservoir 1.

The closure member 3 is advantageously made integrally with the collar 2. As shown in the figures, the closure member 3, on being unmolded, is connected via an annular bridge of material 23 to the collar 2. More precisely, the bridge of material 23 connects the junction surface 310 of the element 31 to a peripheral edge 200 formed by the radial plate 20. This configuration has the advantage of guaranteeing first use, with it not being possible to extract the fluid contained in the reservoir before the bridge of material 23 has been broken.

During first use, the bridge of material must thus be broken. It is broken by a pulling, pushing, or turning movement of the closure member 3 relative to the collar. This has the effect of creating an orifice 24 that is defined by the peripheral edge 200 of the radial plate 20. The closure member 3 may thus be removed freely from the reservoir 1 and from the collar 2. This configuration thus gives rise, in the open position, to a closure member 3 that is compatible with extracting and applying fluid. It should be observed that the orifice 24 is advantageously formed in the center of the radial plate 20, and that the orifice presents any appropriate shape: circular; oblong; elliptical; etc. The dimension of the orifice 24 is advantageously such that the fluid is retained by capillarity in the orifice if the dispenser is tilted, or even turned upside-down. To do this, the orifice 24 advantageously presents a diameter that is small, lying in the range about 2 millimeters (mm) to 6 mm, and preferably about 3 mm to 4 mm.

It should be observed that the peripheral edge 200 forming the orifice 24 serves initially as a fastener point for the breakable bridge of material, and then as an annular sealing zone that co-operates with the sealing surface 312 of the closure member.

The closure member may be put back into place. The closure member may thus define a closed position. This position enables the closure member 3 to be held securely on the collar 2. To do this, a snap-fastener system is provided. The snap-fastener system involves the peripheral edge 200 of the collar 2 co-operating with the snap-fastener bead 311 of the element 31. This co-operation takes place as a result of the closure member being pressed hard enough for the peripheral edge 200 to pass over the snap-fastener bead 311. Once the snap-fastener bead 311 has been passed over, the peripheral edge 200, which is retained by the snap-fastener bead 311, holds the closure member in its closed position. In this position, the peripheral edge 200 is thus in sealing engagement with the sealing surface 312 of the element 31, thereby avoiding any possibility of fluid leaking between the element 31 and the collar 2.

Finally, when it is desired by the user to return to the open position, simple traction exerted on the closure member 3 enables the peripheral edge 200 to pass over the snap-fastener bead 311, thereby enabling the element 31 to be removed.

Thus, the wiper means 25 are formed integrally with the fastener collar 2 that may also advantageously be formed integrally with the closure member. In the final assembled position, as shown in FIG. 6 for example, the wiper ring 260 formed by the bottom free ends 262 of the tabs 26 extends around the stem 314, creating a contact or leaving a small annular gap. Light contact without friction is advantageous, since it enables the wiper ring 260 to scrape the stem 314 lightly, so as to clean it and keep it clean.

When it is desired to use the applicator device of the invention for the first time, the user must firstly separate the closure member 3 from the fastener collar 2 by breaking the bridge of material 23. This is performed by pulling, twisting, or turning. Then, the user may remove the extractor and applicator member 31 from the reservoir, through the collar 2. Removal is performed firstly by sliding the stem 314 through the wiper means 25. The wiper ring 260 thus slides, optionally with friction, along the stem 314 as far as the extractor and applicator section 315. FIGS. 7 and 8 show the applicator device in this position. It can be seen and understood that the extractor and applicator section 315 is situated just below the wiper ring 260, for pulling through the ring 260 for the purpose of wiping it, in part, so as to leave only the necessary quantity of fluid. Given that the section 315 presents a cross-section that is slightly greater than the cross-section of the stem 314, but that its consistency is soft, spongy, and/or deformable, the section 315 deforms in contact with the wiper ring 260 so as to squeeze out therefrom a portion of the fluid that it has extracted from the reservoir. Once the closure member 3 has been removed entirely from the collar 2, the user may apply the fluid extracted by the section 315. When application has terminated, the user inserts the element 31 once again into the reservoir, through the collar 2. Insertion has the effect of causing the section 315 to pass once again through the wiper ring 260. Once again, fluid may be squeezed out. However, there is no risk of the fluid remaining at the wiper means 25, given that the tabs 26 are separated by triangular slots 27. Thus, the fluid can flow out from the wiper means 25, through the slots.

By means of the invention, wiper means form an integral part of the part that is fastened on the reservoir, and advantageously, the fastener part is made integrally with the closure member that forms the extractor and applicator element that is to be wiped through the wiper means.

The invention claimed is:

1. A fluid applicator device, comprising:

a fluid reservoir (1) including a neck (11) defining an inside wall (12) defining an opening (10);

a fastener collar (2) that is assembled in sealed manner on the neck (11) of the reservoir, the collar (2) defining an orifice (24); and a closure member (3) that is capable of closing the orifice (24) of the collar (2), the closure member including a fluid extractor and/or applicator element (31) that extends through the orifice of the collar and into the reservoir (1);

the collar having a wiper means (25) formed integrally therewith for wiping the extractor and/or applicator element (31) while being removed from the reservoir;

wherein the wiper (25) includes a plurality of tabs that are movable through radial deformation between an initial radially outward position prior to being assembled on the neck, and a final radially inward position after being assembled on the neck, the plurality of tabs being constrained in the final position by the neck (11) of the reservoir.

2. An applicator device according to claim 1, wherein said collar (2) and said closure member (3) are made integrally by being connected together via a bridge of material (23) that breaks during first use.

3. An applicator device according to claim 1, wherein the wiper (25) are constrained in the final position by the inside wall (12) of the neck.

4. An applicator device according to claim 1, wherein the wiper (25) comprise a plurality of tabs (26) that are movable radially inwards towards the extractor and/or applicator element (31) by contact with the neck.

5. An applicator device according to claim 4, wherein the tabs (26) define top junction ends (261) and bottom free ends (262), the free ends (262) being movable radially inwards by the tabs pivoting about the junction ends (261).

6. An applicator device according to claim 5, wherein each tab (26) includes an outer cam profile (263) in the proximity of a corresponding junction end (261) of the tab, the cam profile (263) coming into engagement with the inside wall (12) of the neck so as to cause the free end (262) of the tab to pivot inwards.

7. An applicator device according to claim 5, wherein the free ends (262) of the tabs (26) are separated from one another by slots (27) in their initial position, and are substantially touching in their final position, so as to co-operate with one another to define a wiper ring (260).

8. A device according to claim 2, wherein the inside wall (12) of the neck includes an inner inlet bevel (14) for initiating the movement of the wiper (25) from their initial position to their final position.

9. An applicator device according to claim 1, wherein the collar (2) includes a sealing skirt (21) configured to come into sealing contact with the inside wall (12) of the neck, the wiper (25) being formed integrally to extend the skirt (21).

10. An applicator device according to claim 1, wherein the orifice (24) of the collar (2) is defined by a peripheral edge (200) that is connected via said bridge of material (23) to a junction surface (310) of the extractor and/or applicator element (31), said peripheral edge (200) coming into sealing contact against a sealing surface (312) of said extractor and/or applicator element (31) after said bridge of material (23) has been broken.

11. A fluid applicator device, comprising:

a fluid reservoir including a neck defining an inside wall defining an opening;

a fastener collar assembled in sealed manner on the neck of the reservoir, the collar defining an orifice; and a closure member configured to close the orifice of the collar, the closure member including a fluid extractor and/or applicator element that extends through the orifice of the collar and into the reservoir;

the collar comprising wipers formed integrally with the collar and configured to wipe the extractor and/or applicator element while the extractor and/or applicator element is removed from the reservoir; and the wipers are in the form of a plurality of tabs configured to individually pivot radially inwardly through interaction with the neck from an initial position prior to being assembled on the neck to a final position after being assembled on the neck, the plurality of tabs being constrained radially inward in the final position by the neck of the reservoir.

* * * * *